US006568080B2

(12) United States Patent
Kimmel et al.

(10) Patent No.: US 6,568,080 B2
(45) Date of Patent: May 27, 2003

(54) AIR ASSIST FUEL INJECTORS AND METHOD OF ASSEMBLING AIR ASSIST FUEL INJECTORS

(75) Inventors: James Allen Kimmel, Williamsburg, VA (US); David Christopher Kilgore, Williamsburg, VA (US)

(73) Assignee: Synerject, LLC, Newport News, VA (US)

( * ) Notice: Subject to any disclaimer, the term of this patent is extended or adjusted under 35 U.S.C. 154(b) by 0 days.

(21) Appl. No.: 10/113,566

(22) Filed: Apr. 2, 2002

(65) Prior Publication Data

US 2002/0104893 A1 Aug. 8, 2002

Related U.S. Application Data

(62) Division of application No. 09/644,800, filed on Aug. 24, 2000, now Pat. No. 6,402,057.

(51) Int. Cl.[7] ..... B21K 1/20

(52) U.S. Cl. ..... 29/890.124; 29/888.46; 29/888.4; 29/469

(58) Field of Search ..... 29/890.124, 890.12, 29/428, 890.131, 469, 888, 888.01, 888.4, 888.46; 123/296, 297, 533, 531; 251/129.01, 129.21; 239/408, 533.7, 406, 407, 415, 585.1–585.5; 137/607

(56) References Cited

U.S. PATENT DOCUMENTS

| | | | | |
|---|---|---|---|---|
| 3,300,672 A | | 1/1967 | Fisher | |
| 3,809,024 A | * | 5/1974 | Abbey | 123/244 |
| 4,124,003 A | | 11/1978 | Abe et al. | |
| 4,434,766 A | | 3/1984 | Matsuoka et al. | |
| 4,462,760 A | | 7/1984 | Sarich et al. | |
| 4,516,548 A | | 5/1985 | May | |
| 4,519,356 A | | 5/1985 | Sarich | |
| 4,527,520 A | | 7/1985 | Koch | |
| 4,554,945 A | | 11/1985 | McKay | |
| 4,561,405 A | | 12/1985 | Simons | |
| 4,674,462 A | | 6/1987 | Koch et al. | |
| 4,693,224 A | | 9/1987 | McKay | |
| 4,712,524 A | | 12/1987 | Smith et al. | |
| 4,719,880 A | | 1/1988 | Schlunke et al. | |

(List continued on next page.)

FOREIGN PATENT DOCUMENTS

| | | |
|---|---|---|
| AU | 21034/77 B1 | 7/1978 |
| AU | 26285/77 B1 | 1/1979 |
| AU | 62857/80 B | 4/1981 |
| AU | 66453/81 B | 8/1981 |
| AU | 71108/81 A1 | 12/1981 |

(List continued on next page.)

OTHER PUBLICATIONS

Orbital, "Automotive 4–Stroke", http://www.orbeng/com.au/tech/di4ssae.htm.

Orbital, "Automotive 2–Stroke", http://www.orbeng/com.au/tech/di2assae.htm.

Orbital, "Orbital Direct Injected Four Stroke Technology", pp. 1–2, Printed Apr. 15, 1999, http://www.orbeng/com.au/tech/di4ssae.htm.

(List continued on next page.)

*Primary Examiner*—Irene Cuda-Rosenbaum
*Assistant Examiner*—T. Nguyen
(74) *Attorney, Agent, or Firm*—Cooley Godward LLP

(57) ABSTRACT

A first air assist fuel injector configured for operation with a two stroke engine and a second air assist fuel injector configured for operation with a four stroke engine. The first air assist fuel injector and the second air assist fuel injector share one or more common items, such as a solenoid coil assembly and/or an armature, even though the air assist fuel injectors are configured for different applications.

7 Claims, 11 Drawing Sheets

U.S. PATENT DOCUMENTS 4,753,213 A 6/1988 Schlunke et al.
4,754,735 A 7/1988 Simons
4,754,739 A 7/1988 Czwienczek et al.
4,759,335 A 7/1988 Ragg et al.
4,760,832 A 8/1988 Smith et al.
4,781,164 A 11/1988 Seeber et al.
4,790,270 A 12/1988 McKay et al.
4,794,901 A 1/1989 Hong et al.
4,794,902 A 1/1989 McKay
4,800,862 A 1/1989 McKay et al.
4,803,968 A 2/1989 Czwienczek et al.
4,807,572 A 2/1989 Schlunke
4,817,873 A 4/1989 McKay
4,825,828 A 5/1989 Schlunke et al.
4,841,942 A 6/1989 McKay
4,844,040 A 7/1989 Leighton et al.
4,844,339 A 7/1989 Sayer et al.
4,867,128 A 9/1989 Ragg et al.
4,886,021 A 12/1989 Seeber et al.
4,886,120 A 12/1989 Shupe
4,901,687 A 2/1990 Jones
4,920,745 A 5/1990 Gilbert
4,920,932 A 5/1990 Schlunke
4,924,820 A 5/1990 Lear et al.
4,926,806 A 5/1990 Ahern et al.
4,934,329 A 6/1990 Lear et al.
4,936,279 A 6/1990 Ragg
4,938,178 A 7/1990 Schlunke et al.
4,945,886 A 8/1990 McKay et al.
4,949,689 A 8/1990 Schlunke
4,989,557 A 2/1991 Penney
4,993,394 A 2/1991 McKay et al.
5,018,498 A 5/1991 Hoover
5,024,202 A 6/1991 McKay
5,090,625 A 2/1992 Davis
5,091,672 A 2/1992 Below
5,094,217 A 3/1992 Kaku et al.
5,113,829 A 5/1992 Motoyama
5,115,786 A 5/1992 Yamada
5,123,399 A 6/1992 Motoyama et al.
5,150,836 A 9/1992 McKay et al.
5,163,405 A 11/1992 Ahern et al.
5,170,766 A 12/1992 Haas et al.
5,195,482 A 3/1993 Smith
5,205,254 A 4/1993 Ito et al.
5,209,200 A 5/1993 Ahern et al.
5,220,301 A 6/1993 Haas et al.
5,245,974 A 9/1993 Watson et al.
5,251,597 A 10/1993 Smith et al.
5,265,418 A 11/1993 Smith
5,267,545 A 12/1993 Kitson
5,279,327 A 1/1994 Alsobrooks et al.
5,291,822 A 3/1994 Alsobrooks et al.
5,315,968 A 5/1994 Niebrzydoski
5,358,181 A 10/1994 Tani et al.
5,377,630 A 1/1995 Schlunke et al.
5,377,637 A 1/1995 Leighton et al.
5,379,731 A 1/1995 Sayer
5,381,816 A 1/1995 Alsobrooks et al.
5,392,828 A 2/1995 Watson et al.
5,398,654 A 3/1995 Niebrzydoski
5,403,211 A 4/1995 Sayer et al.
RE34,945 E 5/1995 Sayer et al.
5,427,083 A 6/1995 Ahern
5,441,019 A 8/1995 Sayer et al.
5,477,833 A 12/1995 Leighton
5,477,838 A 12/1995 Schlunke et al.
5,483,944 A 1/1996 Leighton et al.
5,516,309 A 5/1996 Sayer et al.
5,527,150 A 6/1996 Windhofer
5,531,206 A 7/1996 Kitson et al.
5,540,205 A 7/1996 Davis et al.
5,546,902 A 8/1996 Paluch et al.
5,551,638 A 9/1996 Caley
5,558,070 A 9/1996 Bell et al.
5,560,328 A 10/1996 Bell et al.
5,588,415 A 12/1996 Ahern
5,593,095 A 1/1997 Davis et al.
5,606,951 A 3/1997 Southern et al.
5,615,643 A 4/1997 Hill
5,622,155 A 4/1997 Ellwood et al.
5,655,365 A 8/1997 Worth et al.
5,655,715 A 8/1997 Hans et al.
5,685,492 A 11/1997 Davis et al.
5,692,723 A 12/1997 Baxter et al.
5,694,906 A 12/1997 Lange et al.
5,709,177 A 1/1998 Worth et al.
5,730,108 A 3/1998 Hill
5,730,367 A 3/1998 Pace et al.
5,794,600 A 8/1998 Hill
5,803,027 A 9/1998 Bell et al.
5,806,304 A 9/1998 Price et al.
5,819,706 A 10/1998 Tsuchida et al.
5,829,407 A 11/1998 Watson et al.
5,832,881 A 11/1998 Karay et al.
5,833,142 A 11/1998 Caley
5,853,306 A 12/1998 Worth et al.
5,863,277 A 1/1999 Melbourne
5,899,191 A 5/1999 Rabbit et al.
5,904,126 A 5/1999 McKay et al.
5,906,190 A 5/1999 Hole et al.
5,927,238 A 7/1999 Watson
5,941,210 A 8/1999 Hill et al.
5,970,954 A 10/1999 Worth et al.
5,979,402 A 11/1999 Melbourne
5,979,786 A 11/1999 Longman et al.
5,983,865 A 11/1999 Yamashita et al.
6,302,337 B1 * 10/2001 Kimmel ..... 239/408
6,484,700 B1 * 11/2002 Kimmel et al. ..... 123/531

FOREIGN PATENT DOCUMENTS

AU 54978/90 A 1/1991
AU 45546/96 A 11/1996
DE 38 28 764 A1 3/1990
WO WO 87/00583 1/1987
WO WO 91/11609 8/1991
WO WO 93/23662 11/1993
WO WO 94/15094 7/1994
WO WO 94/28299 12/1994
WO WO 94/28300 12/1994
WO WO 95/01503 1/1995
WO WO 95/11377 4/1995
WO WO 95/26462 10/1995
WO WO 97/02424 1/1997
WO WO 97/02425 1/1997
WO WO 97/09520 3/1997
WO WO 97/12138 4/1997
WO WO 97/19358 5/1997
WO WO 97/22784 6/1997
WO WO 97/22852 6/1997
WO WO 98/01230 1/1998
WO WO 98/01659 1/1998
WO WO 98/01660 1/1998
WO WO 98/01663 1/1998
WO WO 98/01667 1/1998
WO WO 98/05861 2/1998
WO WO 99/20895 4/1999
WO WO 99/28621 6/1999
WO WO 99/42711 8/1999
WO WO 99/58846 11/1999
WO WO 99/58847 11/1999

WO WO 00/43666 7/2000

OTHER PUBLICATIONS

Dr. Rodney Houston et al., "Direct Injection 4–Stroke Gasoline Engines, the Orbital Combustion Process Solution", presented at ImechE Euro IV Challenge Future Technologies and Systems Conference, Dec. 4, 1997, London, England, pp. 1–17.

Dave Worth et al., "Design Considerations for the Application of Air Assisted Direct In–Cylinder Injection Systems", SAE 972074, Presented by Nicholas Coplin to the Small Engine Technology Conference in Yokohama, Japan, Oct. 28, 1997, pp. 1–21.

Sam Leighton et al., "The Orbital Combustion Process for Future Small Two–Stroke Engines", Presented at Institut Francais du Petrole International Seminar: A New Generation of Two–Stroke Engines for the Future?, Rueil Malmaison, France, Nov. 29–30, 1993.

Sam Leighton et al., "The OCP Small Engine Fuel Injection System for Future Two–Stroke Marine Engines", SAE Paper 941687, Presented at Society of Automotive Engineers International Off–Highway and Powerplant Congress & Exposition, Milwaukee, Wisconsin, USA, Sep. 12, 1994.

Karl Eisenhauer, "Durability Development of an Automotive Two–Stroke Engine", Presentation at $2^{nd}$ International Seminar "High Performance Spark Ignition Engines for Passenger Cars", Balsamo, Italy, Nov. 23–24, 1995.

Rod Houston et al., "Development of a Durable Emissions Control System for an Automotive Two–Stroke Engine", SAE Paper 960361, The Society of Automotive Engineers Congress, Detroit, Michigan, Feb. 26–29, 1996.

Nicholas Coplin, "Application of Air Assisted Direct Injection to High Performance Sports Motorcycles", Presented to the Petroleum Authority of Thailand at Seminar on "Engine Technologies to Reduce Emissions from Motorcycles", Mar. 21, 1996, PTT, Bangkok, Thailand.

Greg Bell et al., "Exhaust Emissions Sensitivities with Direct Injection on a 50cc Scooter", SAE Paper 970365, Presented at Society of Automotive Engineers SAE International Congress and Exposition, Detroit Michigan, USA Feb. 24, 1997.

Dave Worth et al., "Design Considerations for the Application of Air Assisted Direct In–Cylinder Injection Systems", SAE Paper 972074, Presented by Nicholas Coplin to the Small Engine Technology Conference in Yokohama, Japan, Oct. 28, 1997.

David Shawcross et al., "Indonesia's Maleo Car, Spearheads Production of a Clean, Efficient and Low Cost, Direct Injected Two–Stroke Engine", Presented at the IPC9 Conference, Nov. 16–21, 1997, Nusa Dua, Bali, Indonesia.

Dr. Rodney Houston et al., "Direct Injection 4–Stroke Gasoline Engines, the Orbital Combustion Process Solution", Presented at ImechE Euro IV Challenge Future Technologies and Systems Conference, Dec. 4, 1997.

David Shawcross et al., "A Five–Million Kilometre, 100–Vehicle Fleet Trial, of an Air–Assist Direct Fuel Injected, Automotive 2–Stroke Engine", Society of Automotive Engineers, Inc., 1999.

David Shawcross, "A High Mileage Extended Duration Fleet Trial of Orbital's Direct Fuel Injection Automotive Two–Stroke Engine", Presentation at Engine Expo 99, Hamburg, Germany, Jun. 8–10, 1999.

Dr. Herbert Stocker et al., "Air Assisted Gasoline Direct Injection", Presented at Eurogress Aachen–Automobile and Engine Technology Conference, Aachen, Germany, Oct. 5–7, 1998.

Ramon Newmann, "Orbital's Air Assisted Direct Injection Conbustion Applied to the Automotive Multi–Cylinder Gasoline Four–Stroke Engine", Presentation at Engine Expo 99, Hamburg, Germany, Jun. 1999.

Nicholas Coplin, "Simplification of Air Assisted Direct Injection via Performance Benchmarking", Presented at the Small Engine Technology Conference, Madison, Wisconsin, Oct. 29, 1999.

"On the Road to DI Fuel Economy Gains" Orbital Direct Injection, A Technology Update from the Orbital Engine Corporation, Mar. 2000.

Nicholas Coplin, "Air Assisted Gasoline Direct Injection—A Breath of Fresh Air", Presentation at Engine Expo 2000, Hamburg, Germany, Jun. 2000.

"A Breath of Fresh Air–Air Assisted Direct Fuel Injection—the System of Choice for Low Emissions and Good Fuel Economy", Orbital Engine Corporation, Presented at the Society of Automotive Engineers Congress, Detroit Michigan, Mar. 6–9, 2000.

Geoffrey Cathcart et al., "Fundamental Characteristics of an Air–Assisted Direct Injection Combustion System as Applied to 4 Stroke Automotive Gasoline Engines", Presented at Society of Automotive Engineers Congress, Mar. 6–9, 2000.

David R. Bowden et al., "NVH Characteristics of Air Assisted Direct Injected (DI) Spark Ignition Four Stroke Engines", Presented at the ImechE European Conference on Vehicle Noise and Vibration 2000, May 10–12, 2000.

* cited by examiner

AIR ASSIST FUEL INJECTORS AND METHOD OF ASSEMBLING AIR ASSIST FUEL INJECTORS

This application is a divisional application of application Ser. No. 09/644,800, filed Aug. 24, 2000, now U.S. Pat. No. 6,402,051, the entire content of which is hereby incorporated by reference.

BACKGROUND OF THE INVENTION

1. Field of the Invention

The present invention relates to air assist fuel injectors, and, more particularly, to an assembly of air assist fuel injectors and a method of assembling air assist fuel injectors.

2. Description of the Related Art

Conventional fuel injectors are configured to deliver a quantity of fuel to a combustion cylinder of an engine. To increase combustion efficiency and decrease pollutants, it is desirable to atomize the delivered fuel. Generally speaking, atomization of fuel can be achieved by supplying high pressure fuel to conventional fuel injectors, or atomizing low pressure fuel with pressurized gas, i.e., "air assist fuel injection."

FIG. 1 illustrates a conventional air assist fuel injector 20 mounted to an air/fuel rail 30. The rail 30 houses a conventional fuel injector 40 and also defines a mount for the air assist fuel injector 20. The conventional fuel injector 40 and the fuel rail 30 are configured such that a metered quantity of fuel is delivered from the fuel injector to the air assist fuel injector 20. Additionally, the rail 30 includes a number of passageways 42 that deliver pressurized air to the air assist fuel injector 20. The air assist fuel injector 20 atomizes the low pressure fuel with the pressurized air and conveys the air and fuel mixture to the combustion chamber of an engine (not illustrated).

As illustrated in FIG. 1, the pressurized air from the air/fuel rail 30 and the metered quantity of fuel from the conventional fuel injector 40 enter the air assist fuel injector 20 through an inlet in the center of an armature 26. Thereafter, the fuel and air travel through the interior of a poppet 24, and exit the poppet through small slots near the end or head of the poppet. The poppet 24 is attached to the armature 26, which is actuated by energizing a solenoid 22. When the solenoid 22 is energized, the armature 26 will overcome the force of a spring 28 and move toward a leg 30. Because the poppet 24 is attached to the armature, the head of the poppet will lift off a seat 32 so that a metered quantity of atomized fuel is delivered to the combustion chamber of an engine.

The configuration of two and four stroke engines dictate the external dimensions of the air assist fuel injector 20. Conventionally, separate air assist fuel injectors are manufactured for two and four stroke engine applications to satisfy the different dimensional requirements of the two applications. For example, two stroke engines often require a shorter air assist fuel injector than that required for four stroke engine applications because of strict space constraints directly over the head of the two stroke engine. In contrast, four stroke engine applications often require a narrower air assist fuel injector than that required for two stroke engine applications because of strict space constraints in and around the head of the four stroke engine. Additionally, four stroke engine applications often require a longer air assist fuel injector than that required for two stroke engine applications because the air assist fuel injector must extend into the cam valley, but avoid the valve components and any water passageways. Hence, two stroke engine applications have very tight height restrictions, requiring short air assist fuel injectors, while four stroke engine applications have very tight diameter restrictions, requiring long and very small diameter air assist fuel injectors.

Because of these different dimensional requirements, a single, one-size, air assist fuel injector unfortunately cannot satisfy both two stroke and four stoke commercial applications. Hence, conventional air assist fuel injectors for two stroke engine applications and four stoke engine applications are independently manufactured and thus do not share common parts, especially solenoids. For more than a decade, this constraint has proven to be particularly problematic in attempts to economically manufacture air assist fuel injectors for both two and four stroke applications.

SUMMARY

In light of the previously described problems associated with manufacturing conventional air assist fuel injectors, one object of the many embodiments of the present invention is to provide air assist fuel injectors for both two and four stroke engines that have one or more common parts but also satisfy the dimensional and functional requirements of these applications.

In furtherance of this object, an additional aim of the many embodiments of the present invention is to provide methods of assembling air assist fuel injectors with one or more common parts for both two and four stroke engine applications.

Other objects, advantages and features associated with the embodiments of the present invention will become more readily apparent to those skilled in the art from the following detailed description. As will be realized, the invention is capable of other and different embodiments, and its several details are capable of modification in various obvious aspects, all without departing from the invention. Accordingly, the drawings and the description are to be regarded as illustrative in nature, and not limitative.

DESCRIPTION OF SPECIFIC EMBODIMENTS

FIGS. 1–17 illustrate embodiments of air assist fuel injectors 100, 100'. The air assist fuel injector 100 is configured for a two stroke internal combustion engine, while the air assist fuel injector 100' is configured for a four stroke internal combustion engine. As described further below, and contrary to conventional wisdom, the air assist fuel injectors 100, 100' share a number of identical parts, greatly simplifying and economizing the commercial manufacture of the two air assist fuel injectors 100, 100' as compared to conventional air assist fuel injectors configured for the same applications. Because the air assist fuel injectors 100, 100' are functionally similar and share a number of similar parts, like numbered parts of the injector 100 refer to like numbered parts of the injector 100' in the description that follows.

Figure 19:
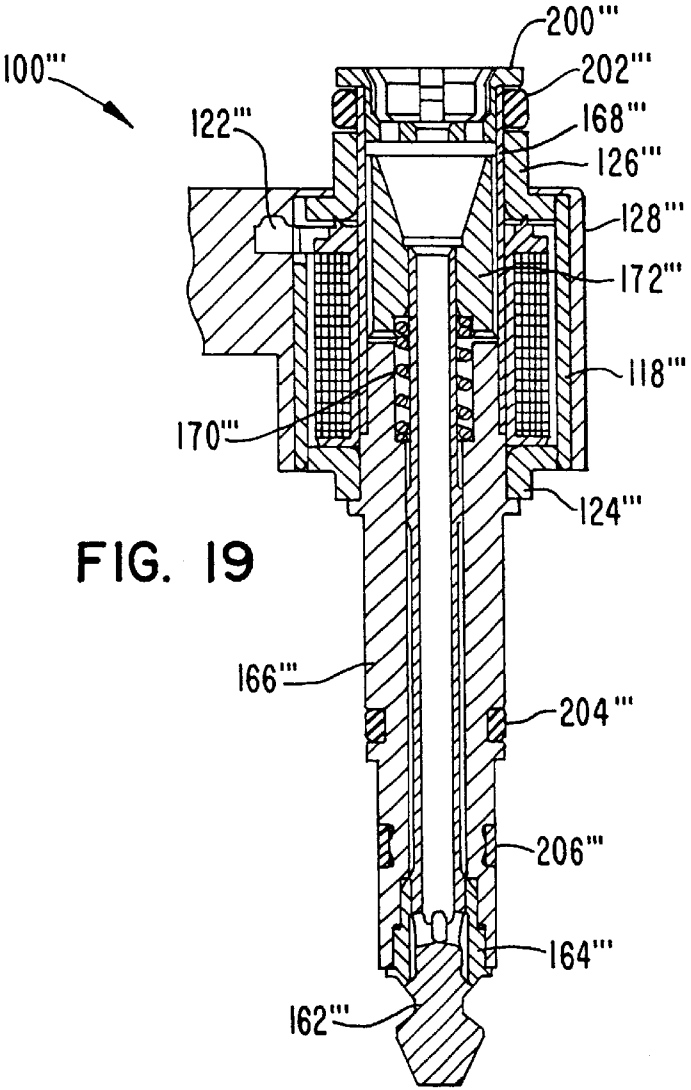
FIG. 19 is a cross-sectional view of an alternative embodiment of an air assist fuel injector configured for a four stroke application in accordance with one embodiment of the present invention.
Figure 18:
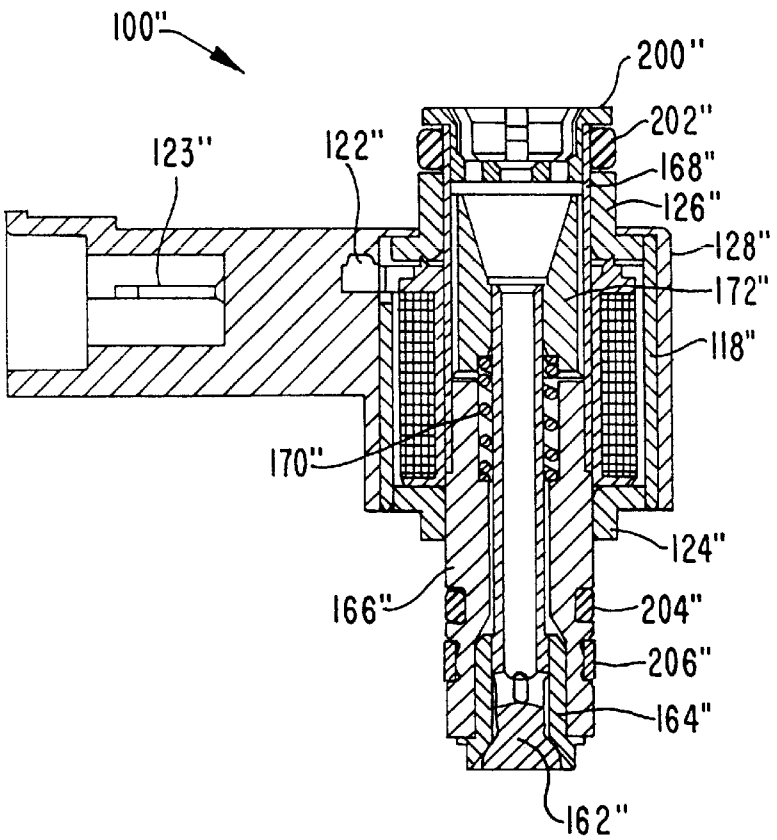
FIG. 18 is a cross-sectional view of an alternative embodiment of an air assist fuel injector configured for a two stroke application in accordance with one embodiment of the present invention.

FIGS. 2–5, 10, 12, and 14 illustrate the components of the air assist fuel injector 100, which is configured for operation with a two-stroke internal combustion engine. FIGS. 6–8, 11, 13, and 15 illustrate the components of the air assist fuel injector 100', which is configured for operation with a four-stroke internal combustion engine. FIG. 18 illustrates an alternative embodiment of an air assist fuel injector 100" configured for operation with a two-stroke internal combustion engine, and FIG. 19 illustrates an alternative embodiment of an air assist fuel injector 100'" configured for operation with a four-stroke internal combustion engine.

Figure 1:
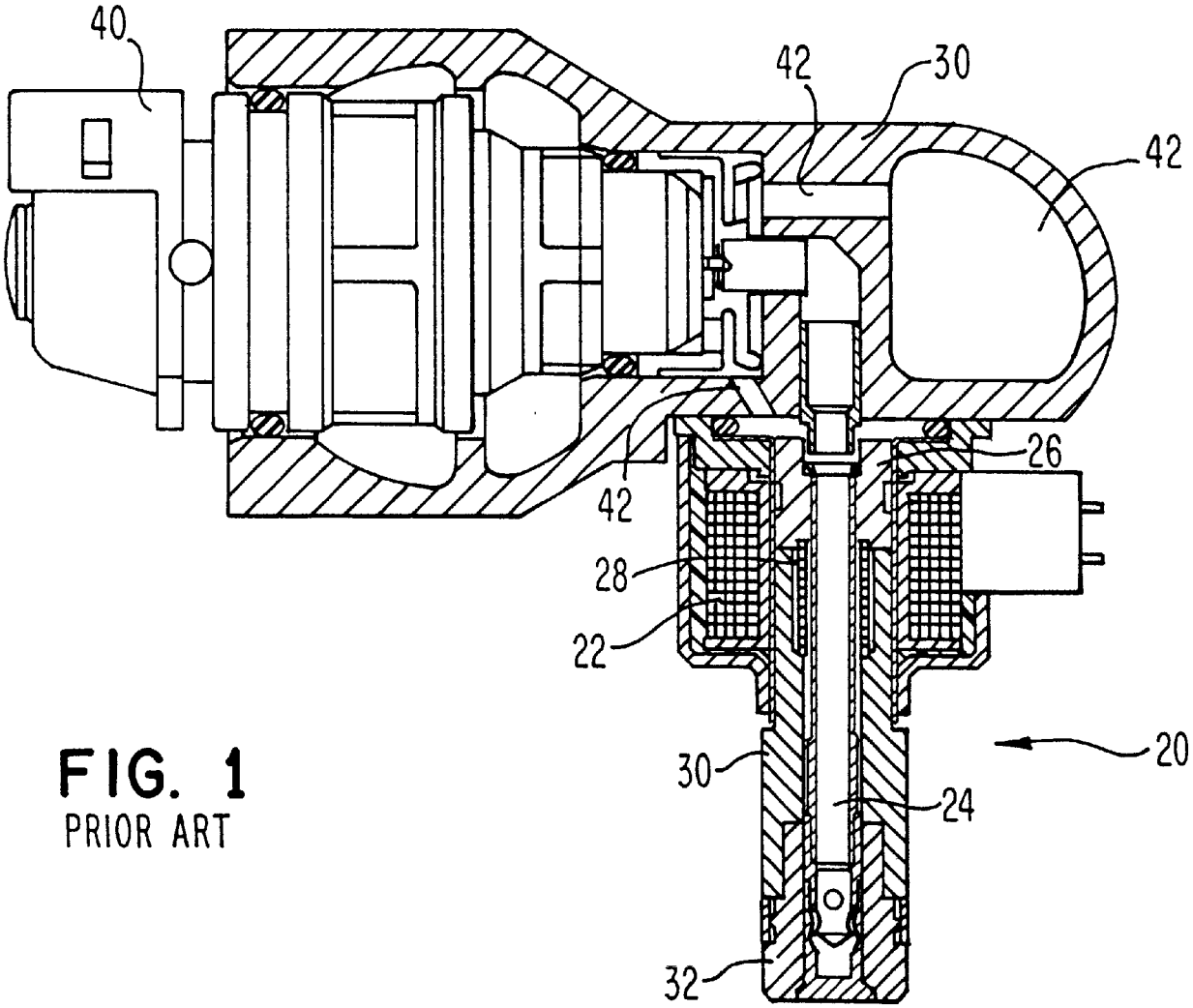
FIG. 1 PRIOR ART
FIG. 1 is a partial cross-sectional view of a conventional air assist fuel injector mounted to a conventional air/fuel rail housing a conventional fuel injector.
Figure 6:
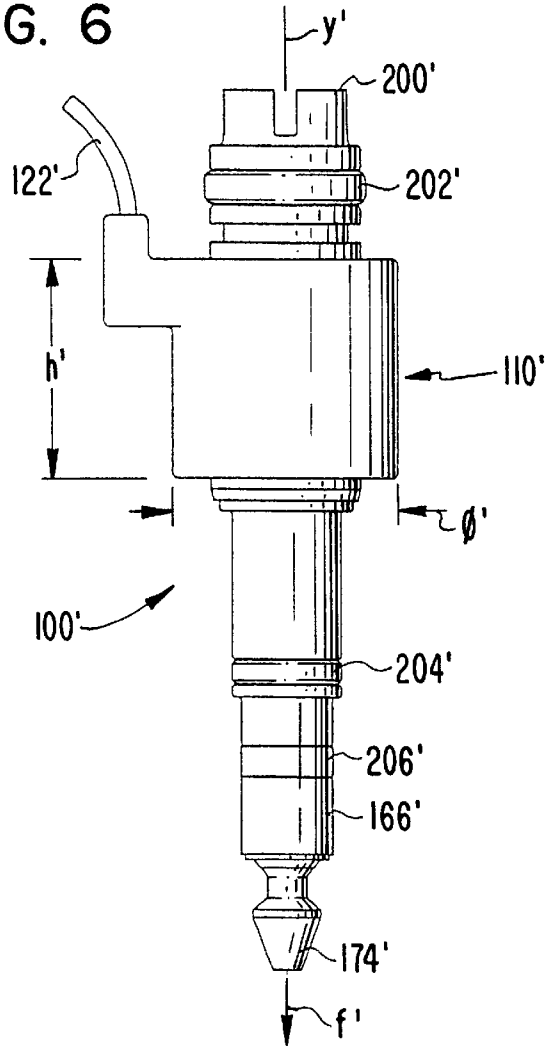
FIG. 6 is a side view of an air assist fuel injector configured for a four stroke engine application in accordance with one embodiment of the present invention.
Figure 2:
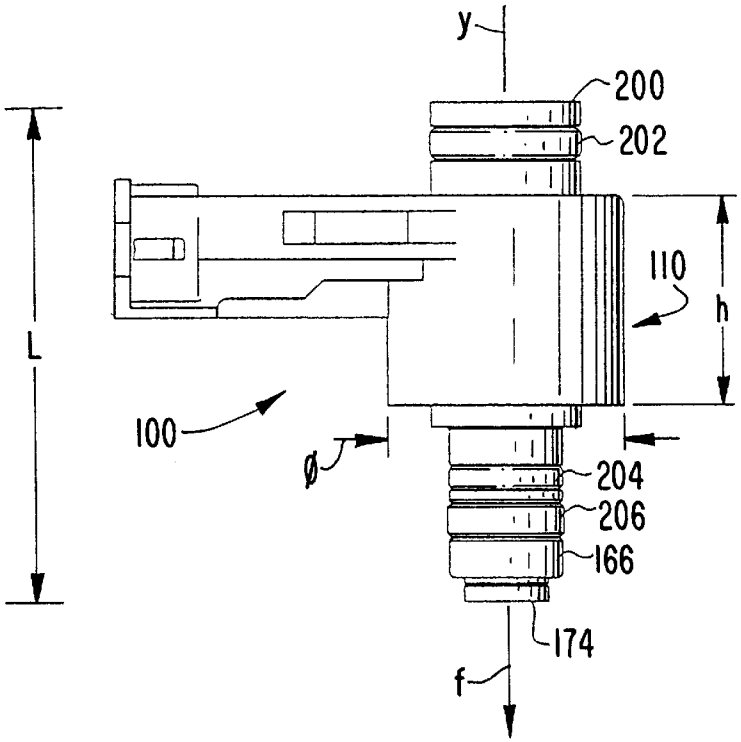
FIG. 2 is a side view of an air assist fuel injector configured for a two stroke engine application in accordance with one embodiment of the present invention.
Figure 3:
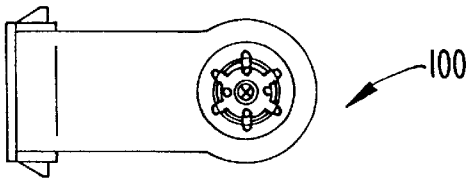
FIG. 3 is a top view of the air assist fuel injector illustrated in FIG. 2.
Figure 9:
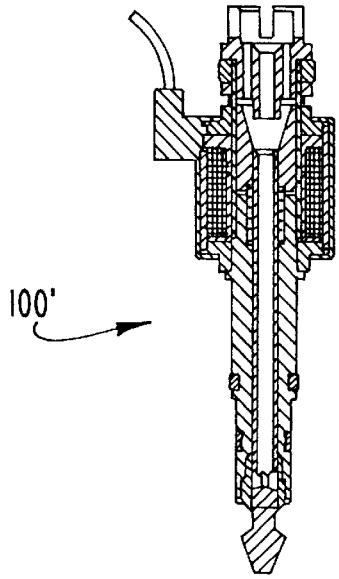
FIG. 9 is a cross-sectional view of the air assist fuel injector illustrated in FIG. 6 taken along the line 9—9 in FIG. 8.
Figure 4:
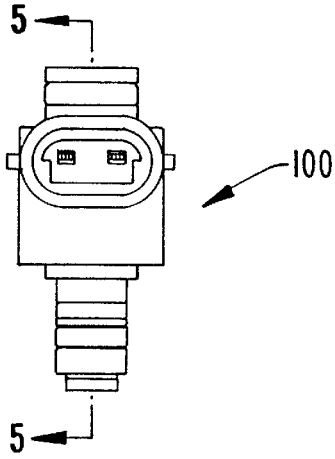
FIG. 4 is a rear view of the air assist fuel injector illustrated in FIG. 2.
Figure 10:
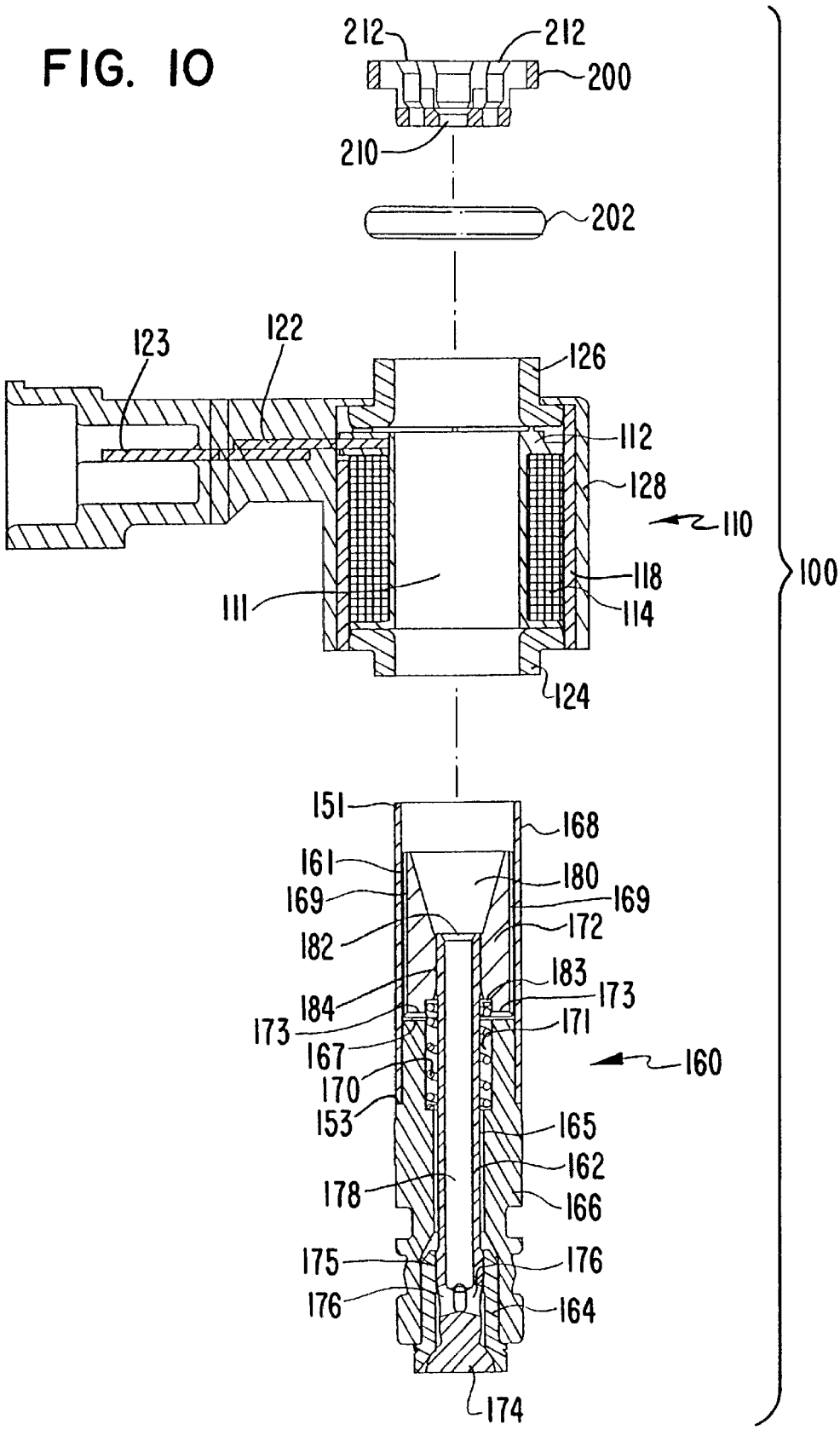
FIG. 10 is an exploded view of FIG. 5.
Figure 11:
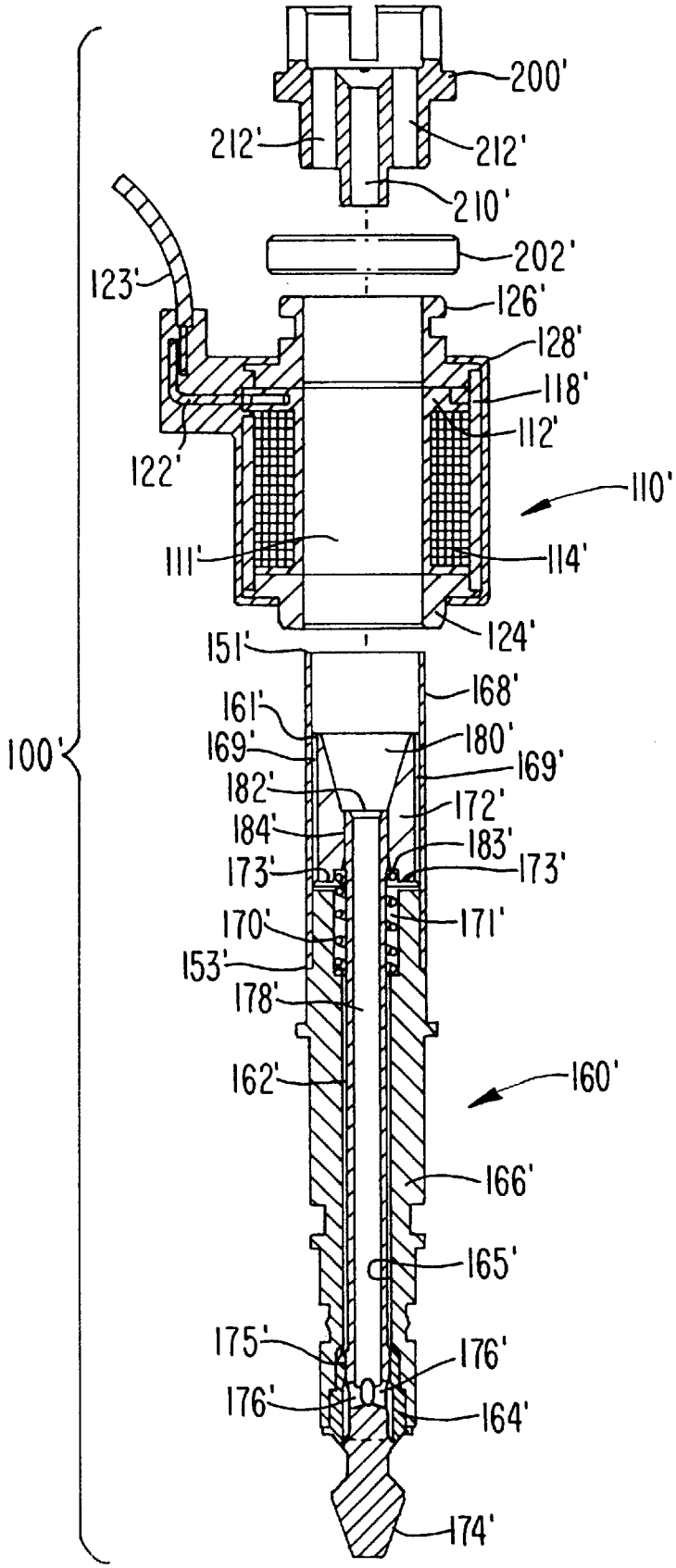
FIG. 11 is an exploded view of FIG. 9.
Figure 13:
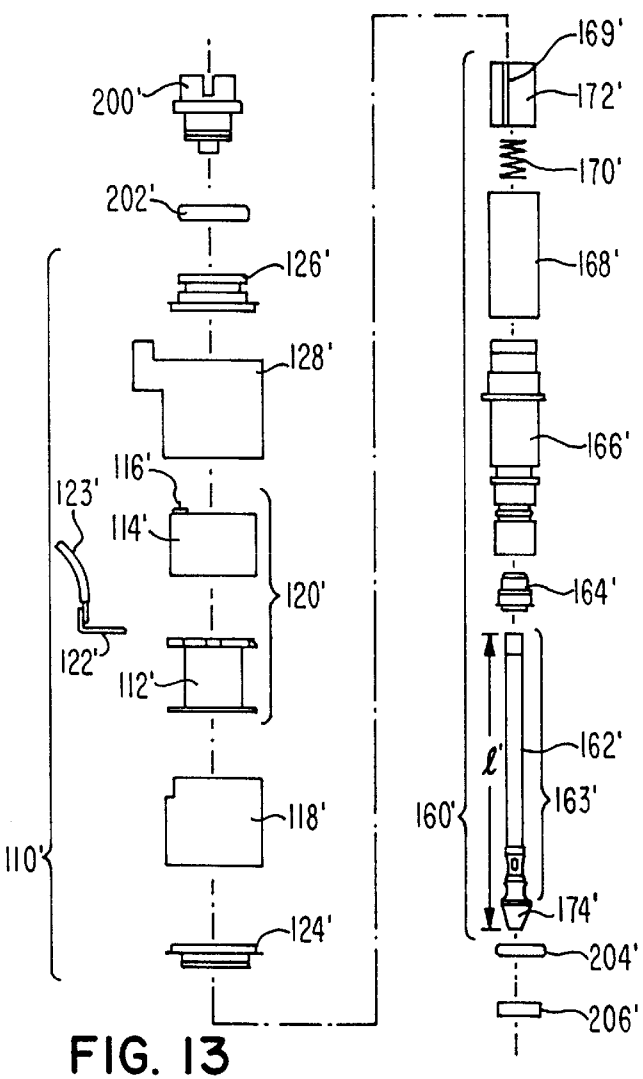
FIG. 13 is an exploded assembly view of the air assist fuel injector illustrated in FIG. 6.
Figure 12:
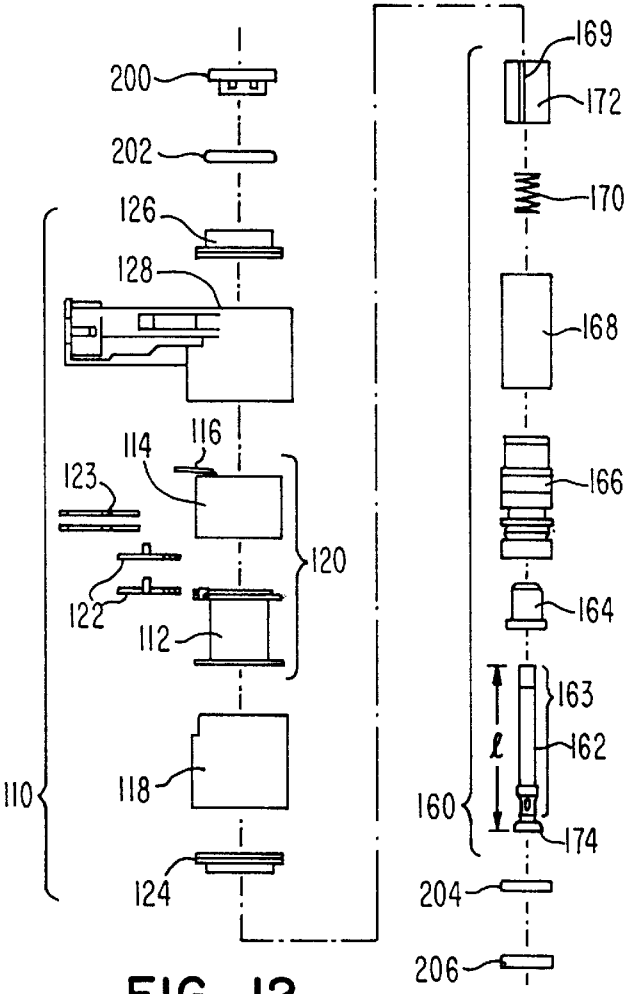
FIG. 12 is an exploded assembly view of the air assist fuel injector illustrated in FIG. 2.

For purposes of comparison FIGS. 2 and 6 illustrate the air assist fuel injectors 100, 100' at the same dimensional scale; FIGS. 3–5 and 7–9 illustrate the air assist fuel injectors 100, 100' at the same dimensional scale; FIGS. 10 and 11 illustrate the air assist fuel injectors 100, 100' at the same dimensional scale; FIGS. 12 and 13 illustrate the air assist fuel injectors 100, 100' at the same dimensional scale; and FIGS. 18 and 19 illustrate the air assist fuel injectors 100", 100'" at the same dimensional scale.

Figure 7:
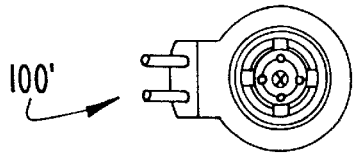
FIG. 7 is a top view of the air assist fuel injector illustrated in FIG. 6.
Figure 8:
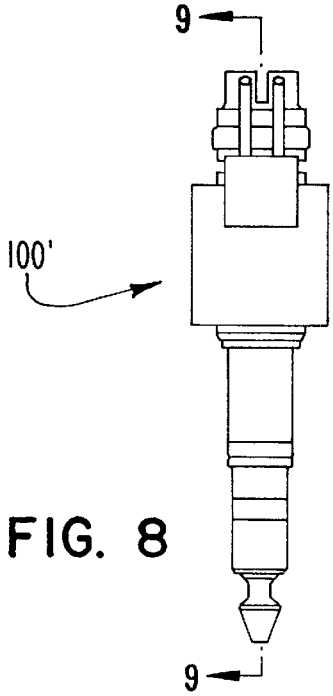
FIG. 8 is a rear view of the air assist fuel injector illustrated in FIG. 6.

As is apparent by comparing FIGS. 2–5 with FIGS. 6–8, the external dimensions, i.e., periphery, of the air assist fuel injectors 100, 100' are significantly different. This is because two stroke and the four stroke internal combustion engines dictate different dimensional requirements for air assist fuel injectors. For example, the dimensions of a two stroke internal combustion engine typically require that the air assist fuel injector 100 be shorter or more compact than that required for a four stroke internal combustion engine. Likewise, the dimensions of a four stroke internal combustion engine typically require that the air assist fuel injector 100' be longer and have a smaller diameter than that required for a two stroke internal combustion engine. Hence, as illustrated by comparing FIGS. 2 and 6, the air assist fuel injector 100 is generally more compact, i.e., shorter, than the air assist fuel injector 100' as measured along a longitudinal axis y, y' of each air assist fuel injector 100, 100'. Accordingly, the air assist fuel injector 100' has a longer length L' as measured along the longitudinal axis y' of the air assist fuel injector 100' than the length L of the air assist fuel injector 100 as measured along the longitudinal axis y, y' of the air assist fuel injector 100. As described further below, various components of the air assist fuel injectors 100, 100' contribute to the overall length L, L' of the air assist fuel injectors. The items, i.e., components or parts, of the air assist fuel injectors 100, 100' are now briefly described, followed by an explanation of the operation of the air assist fuel injectors, and then a description of the assembly of the air assist fuel injectors.

The air assist fuel injectors 100, 100' are configured to utilize pressurized gas to atomize low pressure liquid fuel, which together travel through the respective air assist fuel injectors 100, 100' along a direction of flow f, f', as indicated in FIGS. 2 and 6. As best illustrated by FIGS. 10 and 11, the air assist fuel injectors 100, 100' each include two primary assemblies: a solenoid assembly 110, 110' and a valve assembly 160, 160'. The air assist fuel injectors 100, 100' also each include a cap 200, 200' that defines an inlet to the air assist fuel injector for the pressurized gas and liquid fuel. Each cap 200, 200' includes at least one fuel passageway 210, 210' that receives liquid fuel and at least one gas passageway 212, 212' that receives pressurized gas. In the preferred embodiment of the respective air assist fuel injectors 100, 100', each cap 200, 200' includes only one cylindrical liquid fuel passageway 210, 210' located along the center axis of the cap, and four cylindrical gas passageways 212, 212' circumferentially and equally spaced about the respective liquid fuel passageway 210, 210'. In alternative embodiments, the air assist fuel injectors 100, 100' do not include the respective caps 200, 200' or include alternatively configured caps. For example, the liquid fuel and pressurized gas may enter each air assist fuel injector 100, 100' through an armature 172, 172' of each air assist fuel injector, as opposed to the caps 200, 200'. Alternatively, each cap 200, 200' may include only one passageway that receives liquid fuel and pressurized gas for eventual or immediate delivery to the interior of the respective air assist fuel injectors 100, 100'.

As illustrated by FIGS. 10–13, the solenoid assemblies 110, 110' each at least include a coil 114, 114' of conductive wire wrapped around a tubular bobbin 112, 112'. Each coil 114, 114' preferably includes a winding of insulated conductor that is wound helically around the respective bobbin 112, 112'. The coils 114, 114' each have two ends 116, 116' (see FIGS. 12 and 13) which are each electrically connected, such as soldered, to a terminal 122, 122'. Each coil 114, 144' is energized by providing current to respective connectors 123, 123', which are electrically connected to the respective terminals 122, 122'.

Each coil 114, 114' and bobbin 112, 112' together define a respective solenoid coil assembly 120, 120' of each respective solenoid assembly 110, 110' (see FIGS. 12 and 13). The solenoid coil assembly 120, 120' of each solenoid assembly 110, 110' is that portion of the respective solenoid assemblies that produces a magnetic field when electric current is applied to the respective coils 114, 114'. As illustrated by FIGS. 12 and 13, the solenoid coil assembly 120 of the air assist fuel injector 100 and the solenoid coil assembly 120' of the air assist fuel injector 100' are identical, despite the fact that the air assist fuel injector 100 is configured for operation with a two stroke internal combustion engine and the air assist fuel injector 100' is configured for operation with an four stroke internal combustion engine. Because the solenoid coil assembly 120 and the solenoid coil assembly 120' are identical, they are interchangeable between the two differently configured air assist fuel injectors 100, 100'.

In the preferred embodiments of the air assist fuel injectors 100, 100', the identical solenoid coil assemblies 120, 120' are pre-manufactured such that they have the same shape, size and content. Each pre-manufactured and identical solenoid coil assembly 120, 120' includes the respective bobbin 112, 112', coil 114, 114', and ends 116, 116'. Because the solenoid coil assemblies 120, 120' are identical, the bobbin 112 and the bobbin 112' are identical, the coil 114 and the coil 114' are identical, and the ends 116 and the ends 116' are identical.

One reason why the solenoid coil assemblies 120, 120' are identical is because the Applicants discovered that a common solenoid coil assembly 120, 120' could satisfy the strict dimensional requirements of many two stroke engine and four stroke engine applications, while still satisfying as the functional design requirements of both applications. As illustrated in FIGS. 2 and 6, this is achieved by each solenoid height h, h' being small enough to fit both two stroke and four stroke applications, and each solenoid diameter Ø, Ø' being small enough to fit four stroke applications. In accordance with one embodiment of the present invention, each solenoid height h, h' equals approximately 20 mm and each solenoid diameter Ø, Ø' equals approximately 20 mm. Although these dimensions are preferred, it will be realized that other dimensions for each solenoid height h, h' and each solenoid diameter Ø, Ø' will also suffice, depending upon the dimensional and functional requirements of the specific two stroke engine and four stroke engine applications. Exemplary solenoid coil assemblies 120, 120' suitable for the present invention include those commercially available from Trans Era, located in Ontario, Canada. The preferred identical solenoid coil assemblies 120, 120' have the following specifications: turns=189, wire gauge=27, and resistance= 1.36 Ohm. The normal applied operating voltage is, for example, approximately 14 volts and the minimum operating voltage is approximately 6 volts.

Although each solenoid coil assembly 120, 120' includes the respective bobbin 112, 112', coil 114, 114', and ends 116, 116', alternative embodiments of the solenoid coil assemblies may include other items of the solenoid assembly 110, 110'. For example, the identical solenoid coil assemblies 120, 120' may also include a casing 118, 118', one or more retainers 124, 124', 126, 126', or other items of the respective solenoid assemblies 110, 110'. Additionally, although the preferred embodiments of each solenoid assembly 110, 110' include the items illustrated in FIGS. 10–13 and further described below, it will be appreciated that alternative embodiments of the solenoid assemblies 110, 110' may include more or less of these items, so long as each solenoid assembly includes a coil and a bobbin. For example, each solenoid assembly 110, 110' may only include the respective coil 114, 114' bobbin 112, 112' ends 116, 116' and casing 118, 118'.

Each bobbin 112, 112' of each solenoid coil assembly 120, 120' is essentially a spool on which the conductor of the coil 114, 114' is wound. Each bobbin 112, 112' also defines a throughole 111, 111' in which an armature 172, 172' is electromagnetically actuated, as further described below. Each bobbin 112, 112' and coil 114, 114' are located at least partially within a tubular casing 118, 118' of soft magnetic steel. Hence, the respective tubular casing 118, 118' at least partially encases the respective coil 114, 114'. In the preferred embodiments, the respective casings 118, 118' are identical such that they have the same shape, size and content.

The solenoid assemblies 110, 110' also each include an upper retainer 126, 126' and a lower retainer 124, 124', which are annular bodies that partially close-off the ends of the casing 118, 118'. Each upper retainer 126, 126' and each lower retainer 124, 124' include a cylindrical passageway coincident with the respective throughole 111, 111 ' of the corresponding bobbin 112, 112'. The retainers 126, 126', 124, 124' of each solenoid assembly 110, 110' retain the respective bobbin 112, 112' and coil 114, 114' in the respective casing 118, 118'. The cylindrical passageway of each upper retainer 126, 126' receives at least a portion of the respective cap 200, 200'. Each cap 200, 200' is preferably press fit into the respective armature guide 168, 168'. The cylindrical passageway of each lower retainer 124, 124' receives at least a portion of the respective valve assembly 160, 160'. Each solenoid assembly 110, 110' also includes an overmold 128, 128' of insulative material, such as glass-filled nylon, that houses the respective casing 118, 118' and at least a portion of the respective upper and lower retainers 126, 126', 124, 124'. The respective overmolds 128, 128' also house the terminals 122, 122' and a portion of the connectors 123, 123', as illustrated in FIGS. 10 and 11.

Figure 5:
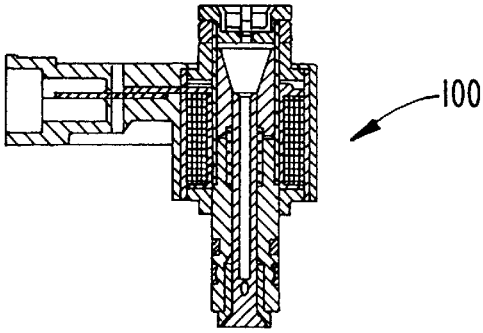
FIG. 5 is a cross-sectional view of the air assist fuel injector illustrated in FIG. 2 taken along the line 5—5 in FIG. 4.

Referring again to FIGS. 10 and 11, the valve assembly 160, 160' of each air assist fuel injector 100, 100' defines the dynamic portion of the air assist fuel injector that functions as a valve to deliver the atomized quantity of liquid fuel and gas. As illustrated in FIGS. 10 and 11, the preferred embodiments of the valve assemblies 160, 160' each include an armature 172, 172', a poppet 162, 162', a seat 164, 164', a leg 166, 166', a spring 170, 170', and an armature guide 168, 168'. The armatures 172, 172' are each formed of a ferromagnetic material, such as 430 FR stainless steel or similar, and each function as the moving part of an electromagnetic actuator, defined by each solenoid coil assembly 120, 120' and respective armature 172, 172' combination. Each armature weighs approximately 3.91 grams. As illustrated in FIGS. 5 and 9, each armature 172, 172' of the respective air assist fuel injector 100, 100' is located relative to the respective solenoid coil assembly 120, 120' such that each armature is subject to the lines of flux generated by the respective solenoid coil assembly. Hence, each armature 172, 172' is actuated when the respective solenoid coil assembly 120, 120' is energized. In the preferred embodiments, each armature 172, 172' is located partially within the respective throughole 111, 111' of the respective bobbin 112, 112'.

Each armature 172, 172' includes a passageway 180, 180' that conveys a mixture of liquid fuel and gas to a respective inlet 182, 182' of the respective poppet 162, 162'. In the preferred embodiment, the passageway 180, 180' of each armature 172, 172' includes a conical conduit extending from a first end of each armature 172, 172' adjacent the respective cap 200, 200' to the respective inlet 182, 182' of the respective poppet 162, 162'. Each inlet 182, 182' is located at an approximate midpoint along the length of the respective armature 172, 172'. However, the passageways 180, 180' may take other forms. For example, the passageways 180, 180' may each be one cylindrical passageway extending the entire length of each armature 172, 172', a plurality of passageways, or other configurations, as will be apparent.

In the preferred embodiments, each armature 172, 172' also includes grooves 169, 169' in the cylindrical exterior surface of the respective armature and grooves 173, 173' in the bottom face of the respective armature. As illustrated in FIGS. 10–13, the grooves 169, 169' extend the entire length of the respective armature 172, 172'. The grooves 169, 169', 173, 173' serve to relieve any pressure differential between an area upstream of the respective armature 172, 172' and an area downstream of the respective armature. The grooves 169, 169', 173, 173' also help reduce surface adhesion between the respective armature 172, 172' and corresponding leg 166, 166'.

As illustrated by FIGS. 12 and 13, the armature 172 of the air assist fuel injector 100 and the armature 172' of the air assist fuel injector 100' are identical, despite the fact that the air assist fuel injector 100 is configured for operation with a two stroke internal combustion engine and the air assist fuel injector 100' is configured for operation with an four stroke internal combustion engine. That is, the armature 172 and the armature 172' have the same shape and size, and are thus interchangeable between the two differently configured air assist fuel injectors 100, 100'.

Each poppet 162, 162' is attached to the corresponding armature 172, 172', which is actuated by energizing the solenoid coil assembly 120, 120'. As illustrated in FIGS. 10 and 11, in the preferred embodiments, each armature 172, 172' includes a cylindrical passageway located downstream of the respective passageways 180, 180' and that matingly receives a first end portion 184, 184' of the respective poppets 162, 162'. Hence, each inlet 182, 182' is located immediately downstream of the respective passageway 180, 180' with respect to the direction of flow f, f' of the mixture of liquid fuel and gas. In the preferred embodiments, the end portion 184, 184' of the respective poppets 162, 162' are each attached to the respective armatures 172, 172' with a welded connection, preferably a YAG laser weld. However, alternative attachments are also contemplated. For example, the poppet 162, 162' may be attached to the armature 172, 172' at any variety of locations with an interference fit, an adhesive, a threaded or screwed attachment, a lock and key attachment, a retaining ring attachment, an electron beam weld, an ultrasonic weld, or other known attachments. Because each poppet 162, 162' is attached to the respective armature 172, 172', each poppet 162, 162' will move with the armature when the armature is actuated by energizing the solenoid assembly 110, 110'. In alternative embodiments, each passageway 180, 180' extends between the upstream end face and the opposing, downstream end face of the respective armature 172, 172', i.e., the entire length of the respective armature, and the first end portion 184, 184' of the each poppet is attached to the respective armature at the downstream end face of the corresponding armature.

Each poppet 162, 162' is an elongated hollow tube for conveying the mixture of liquid fuel and pressurized gas, and each include a stem 163, 163' (see FIGS. 12 and 13) and a head 174, 174'. Each inlet 182, 182' of each poppet 162, 162' opens into a tubular passageway 178, 178', which extends from the inlet 182, 182' to outlets 176, 176,' which are located just prior to the respective head 174, 174' of each poppet. In the preferred embodiments, each poppet 162, 162' includes four slot-shaped outlets 176, 176' that are equally spaced from each other and located approximately transverse to the longitudinal axis of the poppet. Although preferred that each poppet 162, 162' have four slot-shaped outlets 176, 176', other configurations will suffice. For example, each poppet 162, 162' may include one slot shaped outlet, two circular outlets, five oval outlets, or ten pin sized outlets.

Each head 174, 174' is located downstream of the respective outlets 176, 176' and is roughly mushroom shaped with a conical or angled face that seats against the seat 164, 164' when the solenoid assembly is not energized. When each armature 172, 172' is actuated by energizing the respective solenoid coil assembly 120, 120', the respective poppet 162, 162' moves with the corresponding armature such that the respective head 174, 174' is lifted off the corresponding seat 164, 164' in a direction away from the air assist fuel injector. When the respective head 174, 174' is lifted off the corresponding seat 164, 164', a seal is broken between the respective head and seat such that liquid fuel and gas exiting the respective outlets 176, 176' exits each air assist fuel injector 100, 100'.

As also illustrated in FIGS. 10 and 11, movement of each poppet 162, 162' is guided at a bearing 175, 175' between the respective poppet 162, 162' and the corresponding seat 164, 164'. Each bearing 175, 175' is located just prior to the outlets 176, 176' with respect to the direction of flow f, f' of the liquid fuel and gas through the injector. Hence, each poppet 162, 162' and each seat 164, 164' include a bearing surface for guiding movement of the poppet near the head end of each poppet 162, 162'. Because each seat 176, 176' serves as a bearing for poppet movement and also absorbs the impact of the respective head 174, 174' when the poppet valve assembly 160, 160' opens and closes, the seat is preferably fabricated from a wear and impact resistant material, such as hardened 440 stainless steel. It will be appreciated that the air assist fuel injectors 100, 100' need not include a separate seat. For example, each leg 166, 166' may define the respective seat 164, 164' and bearing 175, 175'.

The poppets 162, 162' are elongated because when installed, the air assist fuel injectors 100, 100' each protrude through the head of an engine to reach a combustion chamber. As is illustrated in FIGS. 12 and 13, a length l of the poppet 162 of the air assist fuel injector 100 is less than a length l' of the poppet 162' of the air assist fuel injector 100'. The poppet 162' of the air assist fuel injector 100' is longer than the poppet 162 of the air assist fuel injector 100 because the air assist fuel injector 100' is configured for operation with a four stroke internal combustion engine, which generally requires that the air assist fuel injector 100' extend into a cam valley of the four stroke engine. Because two stroke engines generally do not have an elaborate cam valley as do four stroke engines, it is not necessary that the poppet 162 be as long as the poppet 162'. Moreover, it is preferable that the air assist fuel injector 100, and hence the poppet 162, be as short as possible because of the strict space constraints directly over the head of two stroke engines.

As further illustrated in FIGS. 10 and 11, each poppet 162, 162' moves within the elongated channel 165, 165' of the respective leg 166, 166'. Each leg 166, 166' is an elongated body through which the respective poppet 162, 162' moves and which supports the respective seat 164, 164'. The interior channel of each leg 166, 166' through which the respective poppet 162, 162' moves may also serve as a secondary flow path for the pressurized gas. Hence, when each head 174, 174' lifts off the respective seat 164, 164', pressurized gas flows outside the respective poppet but inside the leg 166, 166' to help atomize the liquid fuel and gas exiting the respective outlets 176, 176'. As illustrated in FIGS. 10–13, each leg 166, 166' has a different length for the same reasons set forth above in regard to the poppets 162, 162'. Poppet 162 weighs approximately 1.4 grams and poppet 162' weighs approximately 2.82 grams.

The spring 170, 170' of each valve assembly 160, 160' is located between the respective armature 172, 172' and leg 166, 166'. More particularly, each spring 170, 170' sits within a recessed bore 171, 171' that is concentric with the elongated channel 165, 165' of the leg. Each bore 171, 171' faces the respective armature 172, 172' and defines a seat for the corresponding spring 170, 170'. Each spring 171, 171' is a compression spring having a first end that abuts the respective armature 172, 172' and a second end that abuts the respective leg 166, 166'. The bottom of each bore 171, 171' defines the seat for the downstream end of the respective spring 170, 170' and a recess 183, 183' defines a seat for the upstream end of the respective spring. The spring 170, 170' functions to bias the respective armature 172, 172' away from the respective leg 166, 166'. When the solenoid coil assembly 120, 120' is not energized, each spring 170, 170' biases the respective armature 172, 172' away from the respective leg 166, 166' and thus the corresponding poppet 162, 162' is maintained in a closed position where the respective head 174, 174' abuts against the corresponding seat 164, 164'. However, when each solenoid coil assembly 120, 120' is energized, the electromagnetic force causes the respective armature 172, 172' to overcome the biasing force of the corresponding spring 170, 170' such that the armature moves toward the leg until it abuts a stop surface 167, 167' of the respective leg 166, 166'. When the solenoid coil assembly 120, 120' is de-energized, the electromagnetic force is removed and the respective spring 170, 170' again forces the corresponding armature 172, 172' away from the respective stop surface 167, 167'.

As illustrated by FIGS. 12 and 13, the spring 170 of the air assist fuel injector 100 and the spring 170' of the air assist fuel injector 100' are identical, despite the fact that the air assist fuel injector 100 is configured for operation with a two stroke internal combustion engine and the air assist fuel injector 100' is configured for operation with a four stroke internal combustion engine. That is, the spring 170 and the armature 170 have the same shape and size, and are thus interchangeable between the two differently configured air assist fuel injectors 100, 100'. In the preferred embodiments, the springs 170, 170' have the following specifications: Spring Rate=3.1 N/mm; Load at 8.24 mm=13.80 N±0.5 N.

As also illustrated in FIGS. 10 and 11, movement of each armature 172, 172' is guided by a bearing 161, 161 ' between the respective outer surface of each armature and the inner surface of the corresponding armature guide 168, 168'. The armature guide 168, 168' is essentially a tube that extends at least a portion of the length of the respective armature 172, 172' to act as a guide for the armature. In the preferred embodiments, each armature guide 168, 168' has a first end 151, 151' located upstream of the respective armature 172, 172' with respect to the direction of flow f, f' and a second end 153, 153' located downstream of the armature with respect to the direction of flow f f' such that each armature guide 168, 168' also seals the solenoid coil assembly 120, 120' from the liquid fuel and gas flowing through the valve assembly 160, 160'. Hence, the second end 153, 153' of each armature guide 168, 168' is sealingly attached to the respective leg, 166, 166' such as by a laser weld or otherwise, and the outer surface of each armature guide near the respective first end 151, 151' serves as a sealing surface for an upper seal 202, 202' (see FIGS. 5 and 9). This arrangement helps prevent any liquid fuel and gas from exiting the air assist fuel injectors 100, 100'. Although the armature guide 168, 168' is preferred, it will be appreciated that the air assist fuel injectors 100, 100' need not include the armature guide. For example, a portion of the respective solenoid assembly 110, 110' or a separate insert may function as a guide for the respective armature 172, 172'. Additionally, the respective solenoid coil assembly 120, 120' may be sealed from the liquid fuel and gas with multiple o-rings, rather than with the aid of each armature guide 168, 168', as will be apparent. Moreover, caps 200, 200' slidably engage each respective armature guide 168, 168' when assembled.

Although in the illustrated embodiment of each air assist fuel injector 100, 100' the armature guides 168, 168' and other portions of each air assist fuel injector are not identical, it will be appreciated that alternative embodiments may include identical armature guides 168, 168', solenoid assemblies, and other parts. For example, FIG. 18 illustrates an air assist fuel injector 100" configured for operation with a two stroke engine and FIG. 19 illustrates an air assist fuel injector 100'" configured for operation with a four stroke engine. Besides having identical solenoid coil assemblies, armatures 172", 172'", and springs 170", 170'", the air assist fuel injectors 100", 100'" also include identical armature guides 168", 168'", lower seals 204", 204'", lower retainers 124", 124'", casings 118",118'", terminals 122",122'", connectors 123", 123'" (not illustrated), overmolds 128", 128'", upper retainers 126", 126'", upper seals 202", 202'" and caps 200", 200'". The air assist fuel injector 100" is identical in every respect to the air assist fuel injector 100, and the air assist fuel injector 100'" is identical in every respect to the air assist fuel injector 100', except that the armature guides 168", 168'", lower seals 204", 204'", seats 164", 164'", lower retainers 124", 124'", casings 118",118'", terminals 122", 122'", connectors 123", 123'", overmolds 128", 128'", upper retainers 126", 126'", upper seals 202", 202'" and caps 200". 200'" of the respective air assist fuel injectors 100", 100'" are also identical, whereas these parts are not identical in air assist fuel injectors 100, 100'. Hence, the respective poppets 162", 162'", legs 166", 162'", carbon damns 206", 206'", and seats 164", 164'" are the only parts that are not identical in the air assist fuel injectors 100", 100'". In alternative embodiments, the air assist fuel injectors 100", 100'" also have identical seats. As will be apparent, the description of the air assist fuel injectors 100, 100' and the description of the method of assembling the air assist fuel injectors 100, 100' is equally applicable to the air assist fuel injectors 100", 100'".

Figure 14:
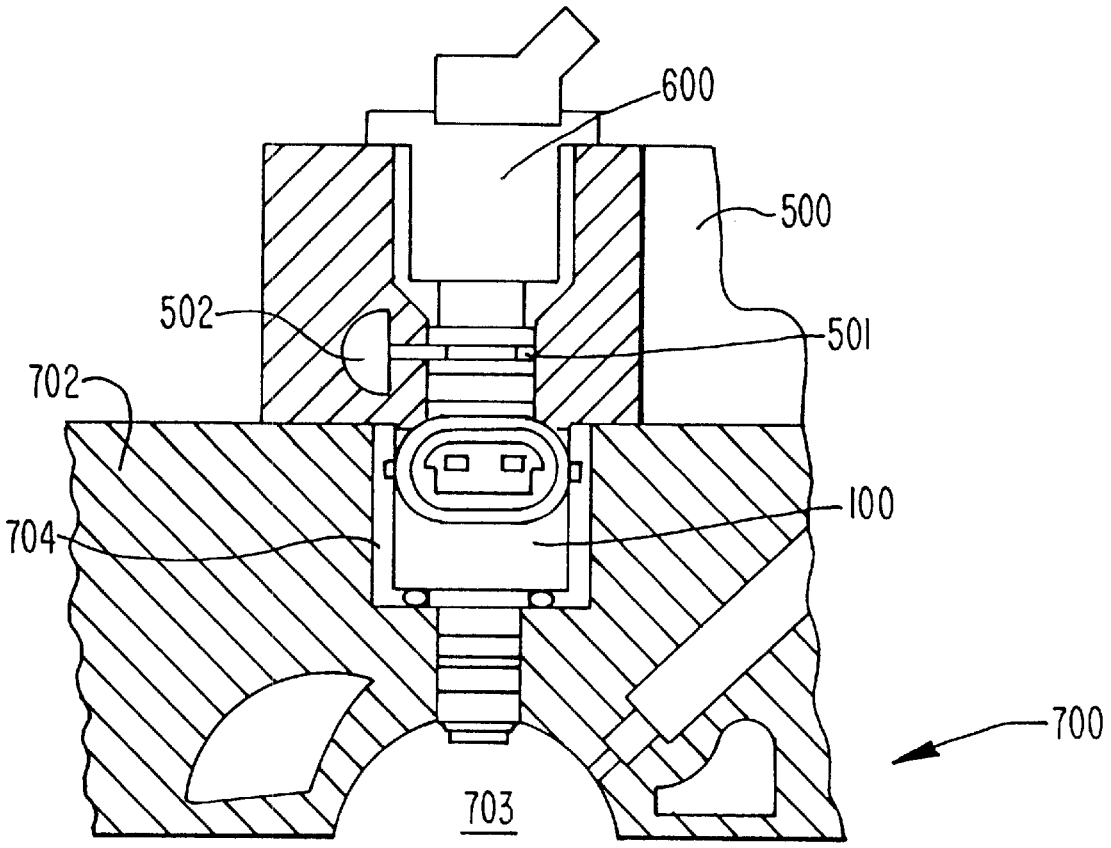
FIG. 14 is a partial cross-sectional view of the air assist fuel injector illustrated in FIG. 2 located in the head of a two stroke internal combustion engine.
Figure 17:
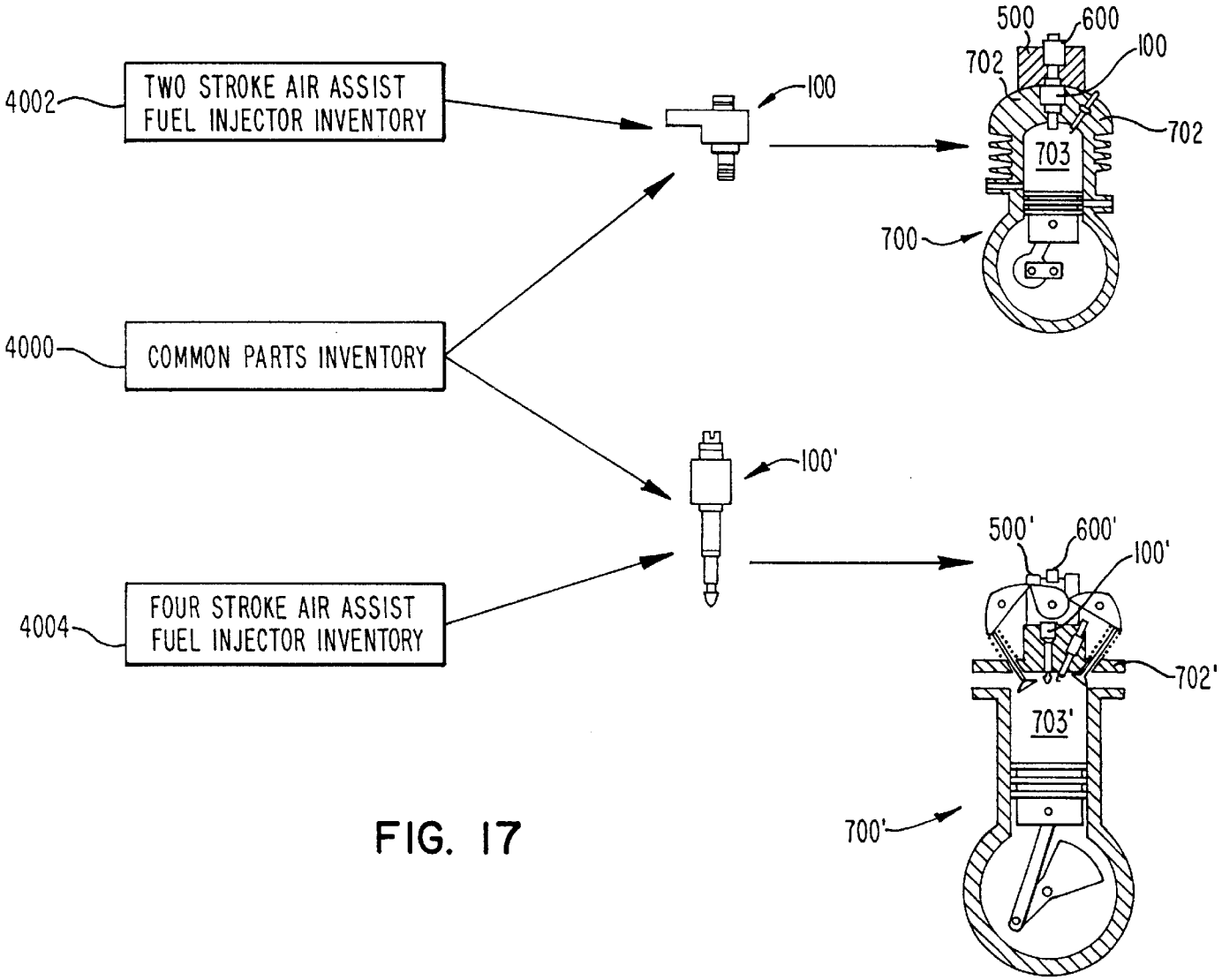
FIG. 17 is a diagram illustrating inventories of parts for assembling the air assist fuel injectors illustrated in FIGS. 2 and 6 in accordance with embodiments of the present invention.

The air assist fuel injectors 100, 100' utilize pressurized air to atomize low pressure fuel. When installed in an engine, the air assist fuel injectors 100, 100' are located such that the atomized low pressure fuel that exits the air assist fuel injectors is delivered to the internal combustion-chamber of an engine, i.e., the part of an engine in which combustion takes place, normally the volume of the cylinder between the piston crown and the cylinder head, although the combustion chamber may extend to a separate cell or cavity outside this volume. For example, as illustrated by FIGS. 14 and 17, the air assist fuel injector 100 is located in a cavity 704 of a two stroke internal combustion engine head 702 such that the air assist fuel injector can deliver a metered quantity of atomized liquid fuel to a combustion cylinder 703 of the two stroke internal combustion engine 700, where it is ignited by a spark plug or otherwise. Likewise, as illustrated by FIGS. 15 and 17, the air assist fuel injector 100' is located in a cavity 704' of a four stroke internal combustion engine head 702' such that the air assist fuel injector can deliver a metered quantity of atomized liquid fuel to a combustion cylinder 703' of a four stroke internal combustion engine 700', where it is ignited by a spark plug or otherwise.

Figure 15:
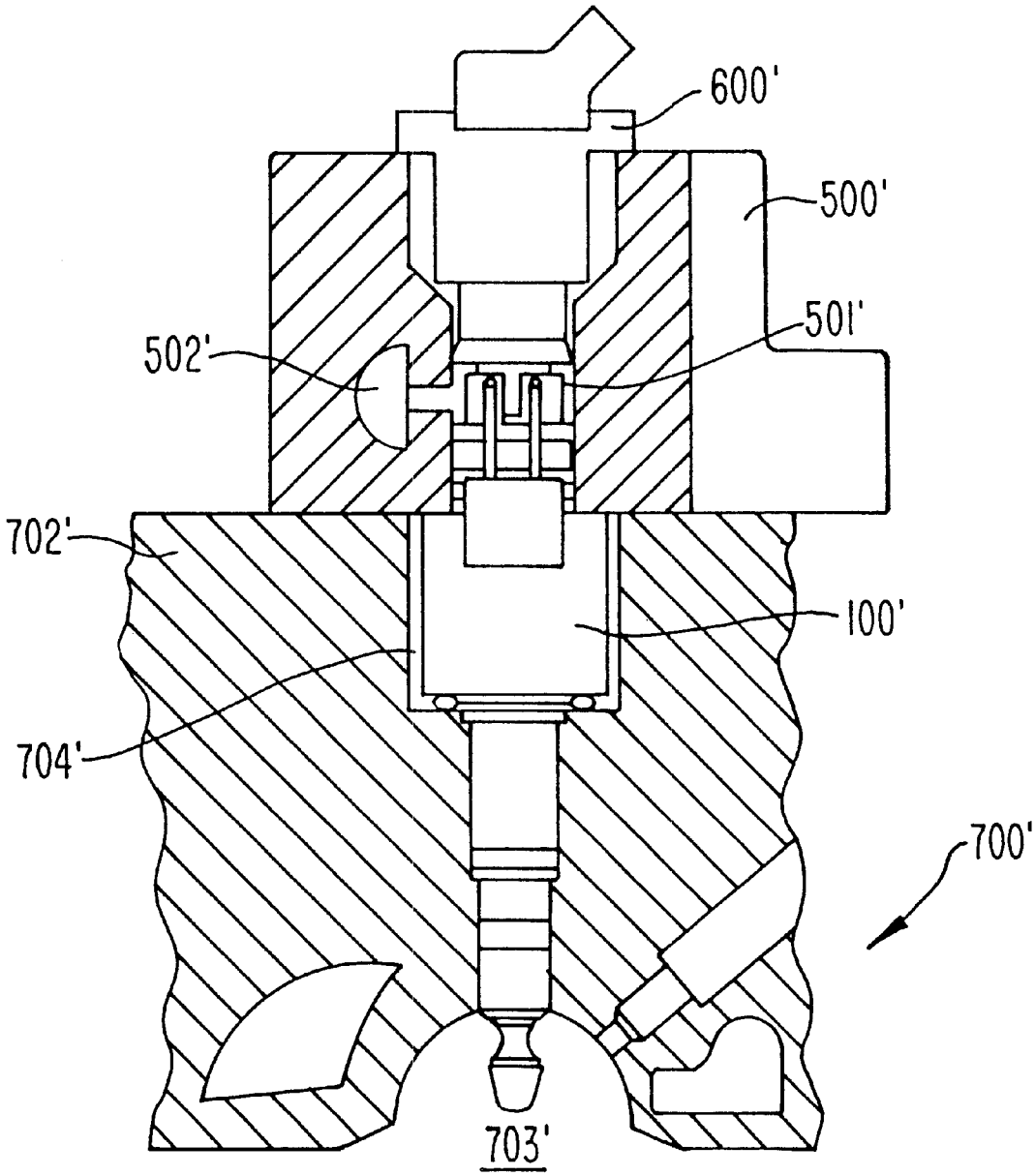
FIG. 15 is a partial cross-sectional view of the air assist fuel injector illustrated in FIG. 6 located in the head of a four stroke internal combustion engine.

As illustrated by FIGS. 14, 15, and 17 the air assist fuel injectors 100, 100' are each located adjacent a conventional fuel injector 600, 600'. The fuel injector 600 is located at least partially in a cavity of an air/fuel rail 500 configured for the two stroke engine 700, and the fuel injector 600' is located at least partially in a cavity of an air/fuel rail 500' configured for the four stroke engine 700'. Examples of fuel injectors 600, 600' that are suitable for delivering liquid fuel to the air assist fuel injectors include any top or bottom feed manifold port injector, commercially available from Bosch, Siemens, Delphi, Nippondenso, Keihen, Sagem, or Magneti Morelli. The air/fuel rails 500, 500' each include one or more internal passageways or external lines (not illustrated) that deliver liquid fuel to the respective fuel injector 600, 600', as well as one or more passageways 502, 502' that deliver pressurized gas, preferably air, to the respective air assist fuel injector 100, 100'.

The air assist fuel injectors 100, 100' are termed "air assist" fuel injectors because each preferably utilizes pressured air to atomize liquid fuel. In the preferred embodiments, the pressure of the air is at roughly 550 KPa for two stroke applications and at roughly 650 KPa for four stroke applications, while the pressure of the liquid fuel is roughly between 620–800 KPa. Although it is preferred that the air assist fuel injectors atomize liquid gasoline with pressurized air delivered by the air/fuel rail, it will be realized that the air assist fuel injectors 100, 100' may atomize many other liquid combustible forms of energy with any variety of gases. For example, the air assist fuel injectors 100, 100' may atomize liquid kerosene or liquid methane with pressurized gaseous oxygen, propane, or exhaust gas. Hence, the term "air assist" is a term of art, and as used herein is not intended to dictate that the air assist fuel injectors 100, 100' be used only with pressurized air.

Each rail 500, 500' also defines a mount for the respective air assist fuel injector 100, 100'. That is, the respective air/fuel rail 500, 500' abuts against at least one surface of the respective air assist fuel injector 100, 100' to retain the air assist fuel injector in place in the respective cavities 704, 704' of the respective heads 500, 500'. In an alternative embodiment not illustrated, an o-ring defines a seal between the air assist fuel injector and the air/fuel rail. Such an o-ring may be considered part of the air assist fuel injector 100 or the air/fuel rail 202. The conventional fuel injectors 600, 600' are configured and located such that they each deliver a metered quantity of liquid fuel directly to the inlet at the respective cap 200, 200' of the air assist fuel injectors 100, 100'. Hence, each cap 200, 200' receives the pressurized gas from the respective air/fuel rail 500, 500' as well as the liquid fuel from the respective conventional fuel injector 600, 600'. Because of the proximity of the outlet of the respective fuel injector 600, 600' with respect to the respective cap 200, 200', the majority of the liquid fuel exiting from the respective fuel injector 600, 600' will enter the respective fuel passageway 210, 210' (see FIGS. 10 and 11). The pressurized gas is delivered to the respective cap 200, 200' via an annular passageway 501, 501' in the respective air/fuel rail 500, 500'. The majority of the pressurized gas conveyed by the respective air/fuel rail 500, 500' will thus enter the gas passageways 212, 212' of the corresponding cap 200, 200'. Hence, each cap 200, 200' functions as an inlet to the respective air assist fuel injector 100, 100' for the pressurized gas and liquid fuel.

The pressurized gas and the liquid fuel mixture exits the respective cap 200, 200' and then enters the respective armature 172, 172' located immediately downstream of the corresponding cap with respect to the direction of flow f, f'. The liquid fuel and pressurized gas mix in the respective passageway 182, 182' of each armature 172, 172' and are conveyed to the respective inlet 182, 182' of each poppet 162, 162'. Thereafter, the liquid fuel and gas travel through the respective tubular passageway 178, 178' of each poppet 162, 162'. When the solenoid coil assemblies 120, 120' are energized, the respective armature 172, 172' overcomes the biasing force of the respective spring 170, 170' and moves toward the corresponding leg 166, 166' until it seats against the respective stop surface 167, 167'. Because each poppet 162, 162' is attached to the respective armature 172, 172', each head 174, 174' of the respective poppet lifts off of the seat in the direction of flow f, f'when the respective armature is actuated. When each head 174, 174' lifts off of the respective seat 164, 164', a seal between the head and the seat is broken and the gas and fuel mixture exits the outlets 176, 176'. The mixture exiting each set of outlets 176, 176' is then forced out of each air assist injector 100, 100' over the respective head 174, 174' such that a metered quantity of atomized liquid fuel is delivered to the respective combustion chamber 703, 703'.

When the previously described solenoid coil assembly 120, 120' is de-energized, the biasing force of the respective spring 170, 170' returns the armature 172, 172' to its original position. Because each poppet 162, 162' is attached to the respective armature 172, 172', the corresponding head 174, 174' of each poppet 162, 162' returns to the respective seat 164, 164' to define a seal that prevents further gas and fuel from exiting the respective air assist fuel injector 100, 100'. Hence, the air assist fuel injectors 100, 100' each atomize the liquid fuel supplied by the respective conventional fuel injector 600, 600' with the pressurized gas supplied via the respective air/fuel rail 500, 500'. The atomized fuel is then delivered to the respective combustion chamber 703, 703' of the respective engine 700, 700', where it is ignited to power the respective engine 700, 700'.

Figure 16:
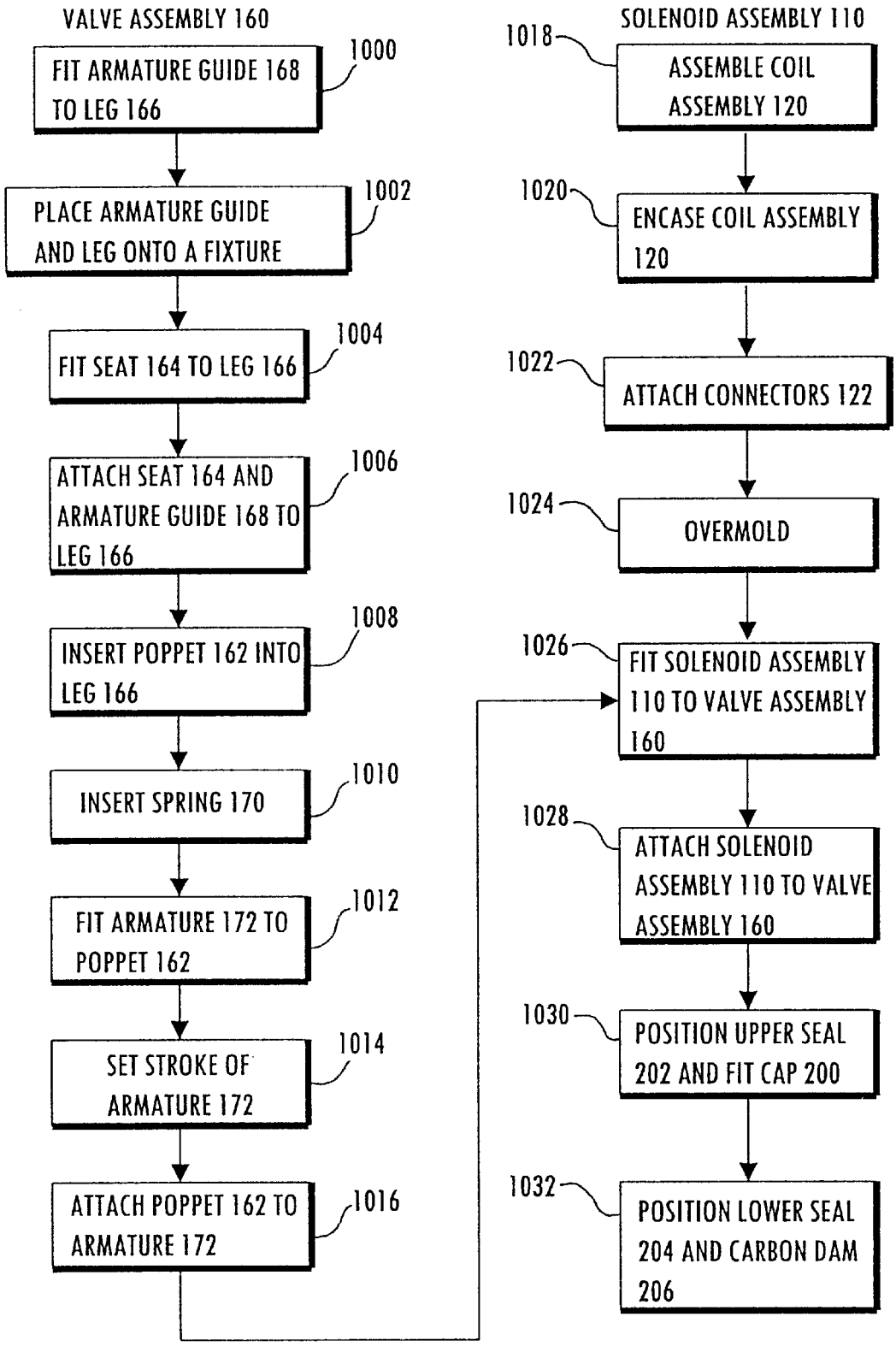
FIG. 16 is a diagram illustrating one method of assembling the air assist fuel injector illustrated in FIG. 2 and/or the air assist fuel injector illustrated in FIG. 6.

One preferred embodiment of assembling the air assist fuel injector 100 is now described in reference to FIGS. 12, 13, 16, and 17. As will be appreciated, the following assembly method is applicable to the air assist fuel injector 100 as well as the air assist fuel injector 100'. Hence, the following description of one method of assembling the air assist fuel injector 100 is also one method of assembling the air assist fuel injector 100'. As illustrated by FIG. 16, the assembly process begins by assembling the valve assembly 160 or the solenoid assembly 110. The valve assembly 160 may also be assembled in parallel with the solenoid assembly 110, i.e., at the same time.

First, considering the assembly of the valve assembly 160, at a step 1000, the armature guide 168 is fitted to the leg 166, preferably by press-fitting the armature guide 168 onto the reduced portion of the leg 166, at the upstream end of the leg 166. Thereafter, at a step 1002, the armature guide 168 and leg 166 combination are placed onto a fixture, such as a rotatable chuck, collet, sleeve, ferrule, etc. At a step 1004, the seat 164 is fitted to the leg 166, preferably by slip-fitting the seat 164 into a cavity in the downstream end of the leg 166. As illustrated by FIG. 16, at a step 1006, the seat 164 and the armature guide 168 are then attached to the leg 166, preferably by one or more hermetic YAG laser welds, although other attachments are also contemplated as described earlier.

After the armature guide 168 and the seat 164 are attached to the leg 166 they are removed from the fixture, and, at a step 1008, the upstream end (seat side) of the poppet 162 is inserted into the tubular passageway 178 of the leg 166 until the poppet head 174 abuts against the seat 164. At a step 1010, the spring 170 is then inserted into the annular area 171 between the poppet 162 and the interior surface of the leg 166 at the upstream end of the leg. Then, at a step 1012, the armature 172 is fitted to the poppet, preferably by a press-fitting the armature over the proximal end of the poppet 162. The armature 172 is press-fit to such an extent that the armature compresses the spring 170 and the armature abuts the stop surface 167 of the leg 166. At a step 1014, a pin or rod is inserted into the passageway 180 of the armature from the upstream side of the armature to push the poppet 162 back out of the armature 172 (in the direction of flow f) to set the stroke or lift of the armature, i.e., the amount of axial movement of the armature during operation. A dial indicator is used on the end of the poppet 162 to measure the stroke during step 1014. After the stroke of the armature 172, and thus the stroke of the poppet 162, are set at step 1014, the assembly of the valve assembly 160 is completed by attaching the poppet 162 to the armature 172 at a step 1016, preferably by hermetically YAG laser welding the armature to the poppet, roughly at the intersection or joint between the passageway 180 and the inlet 182 of the poppet.

The assembly of the solenoid assembly 110 begins with assembling the solenoid coil assembly 120. At a step 1018, the solenoid coil assembly 120 is assembled by winding the conductor of the coil 114 on the bobbin 112 and attaching the ends 116 to the coil. The coil 128 can optionally be encapsulated in a insulative material after being wound on the bobbin 112. At a step 1020, the solenoid coil assembly 120 is encased, preferably by pressing the lower retainer 124 into the solenoid casing 118, placing the solenoid coil assembly 120 into the casing 118, pressing the top retainer 126 into the casing 118, and then welding the retainers 124, 126 to the casing 118. In the preferred embodiment, the solenoid coil assembly 120 is preassembled, i.e., pre-manufactured, and thus the assembly of the solenoid assembly 110 begins at step 1020.

At a step 1022, the terminals 122 and/or the connectors 123 are attached to the ends 116. At a step 1024, the solenoid assembly 110 is completed by overmolding with the overmold 128. To perform the overmold process retainers 124, 126 are welded to the casing 118. Connectors 123 are then welded to terminals 122. Overmold 128 is formed by placing a mold around the solenoid assembly 110. The mold die is placed around the solenoid assembly 110 to form the geometry of overmold 128. Overmold 128 encapsulates the outer diameter of solenoid assembly 110 and seals off around connectors 123.

After the valve assembly 160 and the solenoid assembly 110 are complete, at a step 1026, the solenoid assembly is fitted to the valve assembly, preferably by pressing the solenoid assembly over the valve assembly. Then, at a step 1028, the solenoid assembly is attached to the valve assembly, preferably by a laser weld. After the solenoid assembly 110 and the valve assembly 160 are attached, the upper seal 202 is placed over the upstream end of the sleeve guide 168 and then, at a step 1030, the cap 200 is fitted to the remainder of the injector, preferably by press-fitting the cap 200 into the upstream end of the armature guide 168. To complete the assembly of the air assist fuel injector 200, at a step 1032, a lower seal 204 and a carbon dam 206 are positioned in place. In the preferred embodiment, the lower seal 204 is a viton O ring, and the carbon dam 206 is a Teflon dam.

Although FIG. 16 illustrates the preferred method of assembly of the present invention, it will be appreciated that additional steps may be added and some of the previously described steps may be removed in alternative embodiments of the present invention, depending upon the specific configuration of the air assist fuel injector being assembled. Additionally, it will be appreciated that the order of the steps illustrated in FIG. 16 can vary and still be within the confines of the present invention.

Because of the different configurations of the two stroke internal combustion engine 700 and the four stroke internal combustion engine 700', the air assist fuel injectors 100, 100', as described above, have different external dimensions. Nevertheless, in accordance with the embodiments of the present invention, the air assist fuel injectors 100, 100' are configured such that they share a number of identical parts. As illustrated in FIG. 17, these identical parts are stored in a common parts inventory 4000 when assembling the air assist fuel injectors 100, 100' in the manner described above. When assembling the air assist fuel injectors 100, 100', the common parts inventory 4000 includes one or more of the following: (1) an inventory of identical solenoid coil assemblies 120, 120'; (2) an inventory of identical armatures 172, 172'; and (3) an inventory of identical springs 170, 170'. The remainder of parts for the air assist fuel injector 100 that are not held in the inventory 4000 are stored in a two stoke air assist fuel injector inventory 4002, and the remainder of parts for the air assist fuel injector 100' that are not held in the inventory 4000 are stored in a four stroke air assist fuel injector inventory 4004. Hence, the two stroke air assist injector inventory 4002 for the two stroke air assist fuel injector 100 includes one or more of the following: carbon dam 206, lower seal 204, seat 164, leg 166, armature guide 168, lower retainer 124, casing 118, terminal 122, connector 123, overmold 128, upper retainer 126, upper seal 202, poppet 162, and cap 200. Likewise, the four stroke injector inventory 4004 for the four stroke air assist fuel injector 100' includes one or more of the following: carbon dam 206', lower seal 204', seat 164', leg 166', armature guide 168', lower retainer 124', casing 118', terminal 122', connector 123', overmold 128', upper retainer 126', upper seal 202', poppet 162' and cap 200'.

Hence, when assembling the air assist fuel injector 100 as illustrated in FIG. 16, the solenoid coil assembly 120, the armature 172, and the spring 170 are retrieved from the common parts inventory 4000 and the remainder of the parts (carbon dam 206, lower seal 204, seat 164, leg 166, armature guide 168, lower retainer 124, casing 118, terminal 122, connector 123, overmold 128, upper retainer 126, upper seal 202, poppet 162 and cap 200) for the air assist fuel injector are retrieved from the two stroke air assist fuel injector inventory 4002. When assembling the air assist fuel injector 100', the solenoid coil assembly 120', the armature 172', and the spring 170' are retrieved from the common parts inventory 4000 and the remainder of the parts (carbon dam 206', lower seal 204', seat 164', leg 166', armature guide 168', lower retainer 124', casing 118', terminal 122', connector 123', overmold 128', upper retainer 126', upper seal 202', poppet 162' and cap 200') for the air assist fuel injector 100' are retrieved from the four stroke air assist fuel injector inventory 4004.

In alternative embodiments, the common parts inventory 4000 also includes an inventory of one or more of the following: armature guides, casings, carbon dams, seats, lower retainers, upper retainers, and upper seals. For example, a common parts inventory for the air assist fuel injectors 100", 100'" illustrated in FIGS. 18 and 19 includes identical solenoid coil assemblies, identical armatures 172", 172'", identical springs 170", 170'", identical armature guides 168", 168'", identical carbon dams 206", 206'", identical lower seals 204", 204'", identical lower retainers 124", 124'", identical casings 118",118'", identical terminals 122",122'", identical connectors 123", 123'", identical overmolds 128", 128'", identical upper retainers 126", 126'", identical upper seals 202", 202'" and identical caps 200", 200'". Hence, when assembling the air assist fuel injector 100", the remainder of parts (seat 164", leg 166", and poppet 162") for the air assist fuel injector 100" are retrieved from the two stroke air assist fuel injector inventory. Likewise, when assembling the air assist fuel injector 100'", the remainder of parts (seat 164'", leg 166'", and poppet 162'") for the air assist fuel injector 100'" are retrieved from the four stroke air assist fuel injector inventory.

As set forth above, the configuration of the two stroke engine 700 and the four stroke engine 700' dictate the external dimensions of the air assist fuel injectors 100, 100'. More specifically, two stroke engine applications have very tight height restrictions, requiring short air assist fuel injectors, while four stroke engine applications have very tight diameter restrictions, requiring long and very small diameter air assist fuel injectors. To satisfy the different dimensional requirements of these two applications, it was conventionally thought to separately manufacture two different air assist fuel injectors having no common parts. However, as set forth above, the embodiments of the present invention strive to address this problem by providing air assist fuel injectors 100, 100' that share a number of common parts, especially the solenoid coil assembly 120, 120' and/or armature 172, 172'. The solenoid coil assemblies 120, 120' satisfy the strict dimensional requirements of many two stroke engine and four stroke engine applications, while still satisfying the functional design requirements of the air assist fuel injectors 100, 100' for both applications. That is, each solenoid height h, h' is small enough to fit two stroke engine applications, each solenoid diameter Ø, Ø' is small enough to fit four stroke applications, and the configuration of each solenoid assembly 110, 110' is sufficient to actuate the different length and weight armature/poppet combinations of the two air assist fuel injectors 100, 100'. Hence, the air assist fuel injector 100 is short enough to satisfy two stroke engine applications and the air assist fuel injector 100' is long and narrow enough to satisfy four stroke engine applications, while the solenoid assembly 110, 110' of each air assist fuel injector is sized and configured to fit both two stroke and four stroke applications; this significantly simplifies the manufacture of the air assist fuel injectors 100, 100' as compared to conventional air assist fuel injectors configured for the same applications.

The principles, preferred embodiments, and modes of operation of the present invention have been described in the foregoing description. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. A method comprising:

keeping an inventory of identical solenoid assemblies;

keeping an inventory of identical armatures;

keeping an inventory of identical springs;

keeping an inventory of first poppets having a first length;

keeping an inventory of second poppets having a second length, the first length being different than the second length;

assembling a first air assist fuel injector for a two stroke internal combustion engine with one of the solenoid assemblies, one of the armatures, one of the springs, and one of the first poppets; and assembling a second air assist fuel injector for a four stroke internal combustion engine with another of the solenoid assemblies, another of the armatures, another of the springs, and one of the second poppets.

2. A method comprising:

keeping an inventory of identical solenoid assemblies;

keeping an inventory of first poppets having a first length;

keeping an inventory of second poppets having a second length, the first length being different than the second length;

assembling a first air assist fuel injector for a two stroke internal combustion engine with one of the solenoid assemblies and one of the first poppets; and assembling a second air assist fuel injector for a four stroke internal combustion engine with another of the solenoid assemblies and one of the second poppets.

3. The method of claim 2, further comprising:

keeping an inventory of identical armatures;

said assembling the first air assist fuel injector including assembling the first air assist fuel injector with one of the armatures; and said assembling the second air assist fuel injector including assembling the second air assist fuel injector with another of the armatures.

4. The method of claim 2, further comprising:

keeping an inventory of identical armature guides;

said assembling the first air assist fuel injector including assembling the first air assist fuel injector with one of the armature guides; and said assembling the second air assist fuel injector including assembling the second air assist fuel injector with another of the armature guides.

5. A method comprising:

keeping an inventory of identical armatures;

keeping an inventory of first poppets having a first length;

keeping an inventory of second poppets having a second length, the first length being different than the second length;

assembling a first air assist fuel injector for a two stroke internal combustion engine with one of the armatures and one of the first poppets; and assembling a second air assist fuel injector for a four stroke internal combustion engine with another of the armatures and one of the second poppets.

6. The method of claim 5, further keeping an inventory of identical armature guides;

said assembling the first air assist fuel injector including assembling the first air assist fuel injector with one of the armature guides; and said assembling the second air assist fuel injector including assembling the second air assist fuel injector with another of the armature guides.

7. A method comprising:

keeping an inventory of identical armature guides;

keeping an inventory of first poppets having a first length;

keeping an inventory of second poppets having a second length, the first length being different than the second length;

assembling a first air assist fuel injector for a two stroke internal combustion engine with one of the armature guides and one of the first poppets; and assembling a second air assist fuel injector for a four stroke internal combustion engine with another of the armature guides and one of the second poppets.

* * * * *